US005082441A

United States Patent [19]

Schweder et al.

[11] Patent Number: 5,082,441

[45] Date of Patent: Jan. 21, 1992

[54] APPARATUS FOR SELECTIVELY BREAKING OUT DEPOSITS FROM AND/OR LININGS OF ROTARY KILNS

[75] Inventors: Herbert Schweder; Klaus Lóchl; Wolfgang Rausch, all of Magdeburg; Freidrich Hannemann, Berlingerode; Helmut Leitmont; Ditmar Hahn, both of Magdeburg; Kurt Itziegehl, Deuna, all of Fed. Rep. of Germany

[73] Assignee: VEB Spezialbaukombinat Magdeburg, Magdeburg, Fed. Rep. of Germany

[21] Appl. No.: 622,371

[22] Filed: Dec. 5, 1990

Related U.S. Application Data

[63] Continuation of Ser. No. 328,183, Mar. 24, 1989, abandoned.

[30] Foreign Application Priority Data

Apr. 28, 1988 [DD] German Democratic Rep. ... 315174

[51] Int. Cl.[5] ..... F27D 23/00

[52] U.S. Cl. ..... 432/75; 432/2; 15/104.1 C

[58] Field of Search ..... 432/2, 75; 15/104.1 C

[56] References Cited

U.S. PATENT DOCUMENTS 3,918,375 11/1975 Hayakawa et al. ..... 432/75
4,102,001 7/1978 Baba et al. ..... 432/75
4,775,315 10/1988 Schweder ..... 432/75

FOREIGN PATENT DOCUMENTS 1404780 6/1988 U.S.S.R. ..... 432/75

*Primary Examiner*—Henry C. Yuen
*Attorney, Agent, or Firm*—Schweitzer Cornman & Gross

[57] ABSTRACT

The invention is directed to an apparatus for breaking out deposits and lining from small areas of rotary kilns. The objective, on which the invention is based, is accomplished by an apparatus, which has a front functional element and a rear functional element, which is disposed axially at the thick end of the functional element, a working disk being provided, the protruding, radial, external points of which, constructed as two longitudinally acting double cutting teeth and two transversely acting working teeth, form a circular path in their motion. The conicity adjusters, which can be swung out, form an outer conicity line with the working disk and the contours of the front functional element. In functional vicinity of the working disk at the radial outer edge of the longitudinal ribs of the functional element, said functional element has a curve, on which the inner conicity lines impinge tangentially. To accommodate working elements, plug-in receivers are disposed behind the working disks. The position of these plug-in receivers is fixed on the cross sectional axes of the longitudinal ribs. An effective connection is formed with the double cutting teeth and the working teeth.

9 Claims, 9 Drawing Sheets

APPARATUS FOR SELECTIVELY BREAKING OUT DEPOSITS FROM AND/OR LININGS OF ROTARY KILNS

This is a continuing application of U.S. Ser. No. 328,183, filed on Mar. 24, 1989, now abandoned.

FIELD OF THE INVENTION

The invention is directed to apparatus for selectively breaking out deposits and/or lining from small areas of rotary kilns.

BACKGROUND OF THE INVENTION

In German Democratic Republic No. 238,102, a method and an apparatus for breaking out deposits and lining in rotary kilns is disclosed. This apparatus has the following disadvantages when deposits and lining are broken out with this apparatus from small areas of rotary kilns:

Because of the large mass and working surface of the apparatus, which are effective as a whole, the danger exists that not only the intended small lengths are broken out (attacked, destroyed), but that, in addition, adjacent areas can also be damaged unintentionally. This effect is intensified by the working elements (such as breaking-out teeth), which are disposed on the generally conical circumferential surface.

The construction of the apparatus is complicated by the diversity of the individual elements used, such as the large number of adjusting elements uniformly distributed on the periphery of the stabilizing disk or by the breaking-out teeth mounted on the toothed disks.

Because of the disadvantages cited, a further disadvantage results, which lies in the complicated operation, especially of the adjusting elements. Moreover, at least two arbitrary and adjacent adjusting elements, as they are driven out, must absorb a significant portion of the total weight of the apparatus, which represents a considerable difficulty to the adjusting process.

The establishment of the required stability and serviceability leads to the use of a comparatively large weight with additional manufacturing costs. As a result, the proportional costs for installation, transport and maintenance of the apparatus as well as of the peripheral equipment, are increased.

DESCRIPTION OF THE INVENTION

The objective of the invention is to provide an apparatus, which is to be used for breaking out deposits and lining from small areas of rotary kilns and which brings about a reduction in the manufacturing costs, in the industrial use costs and in the maintenance and repair costs. On the whole, the practical value of the known method is to be increased by this apparatus and a gap in supplies to be closed.

From another aspect, the invention is to provide an apparatus for breaking out deposits and lining from small area of rotary kilns. This apparatus comprises a significant simplification of construction and can be used for kilns turning clockwise as well as counter clockwise. The breaking-out effect is to be concentrated, intact lining outside of the breaking-out zones is not to be affected and the installation and use conditions are to be improved.

Pursuant to the invention, this objective is accomplished by an apparatus for breaking out deposits and lining from small areas of rotary kilns with a ball-shaped conical block, which is constructed from functional elements and at the thick end of which elements are disposed. When the apparatus is at rest, an outer constant conicity line is formed by connecting its points of support and, when the apparatus is in an operating state, an inner, variable conicity line is formed.

It is within the purport of the invention that there are disposed at the rear side thick end of the apparatus an axially supported rear functional support, which is encircled by reinforcing ribs, and three conicity adjusters, adjoining which there is a working disk, the protruding, radial outer points of which form a circular path, with two longitudinally acting double cutting teeth and two transversely acting working teeth. The conicity adjusters and the working disk, together with the pointed end, are disposed as the outer conicity lines of the apparatus. A front functional element, which adjoins the working disk and tapers at the pointed end is disposed. Due to the disposed longitudinal ribs in conjunction with the pointed end, an inner conicity line, which is assigned to the outer conicity line, is disposed in a defined manner.

It furthermore is part of the essence of the invention that these inner conicity lines have a distinctive curve, which is disposed in the functional vicinity of the working disk, the inner conicity line being disposed between the curve and the working disk facing the center line, and that all parts of the apparatus are disposed about a center line and four interchangeable working elements are distributed uniformly over the periphery and disposed detachably in an extension of the radial external points of the longitudinal ribs in the direction of the thick end on plug-in receivers for working elements, a plug-in receiver for the working elements being formed by the common edge of two reinforcing ribs, which are perpendicular to one another, said edge being disposed on the cross sectional axes of the longitudinal ribs in the vicinity of two longitudinally acting double cutting teeth.

It is a feature of the invention that the reinforcing ribs are disposed behind the working disk in the direction of the thick end in combination with the swivel-mounted guiding system of the conicity adjusters. One embodiment consists therein that the swivelling axes of the three conicity adjusters are adjustably disposed in the immediate vicinity of the working disk at swivel-mounted guiding system with a pivoting angle of 0° to 90° perpendicular to the center line. One conicity adjuster is disposed on the upper half of the perpendicular with respect to the plane of the working disk, one conicity adjuster is disposed on the left side of the horizontal and one conicity adjuster is disposed on the right side of the horizontal. Capping pieces are disposed at the outer end of each conicity adjuster.

In an advantageous embodiment, the capping pieces are disposed parallel to or at an oblique angle to the swivelling axis and preferably in a curved outer course, the curved outer course being disposed to match the circular path of the working disk. The arc length of the capping pieces is not smaller than 1/16 of the periphery of the circular path. Preferably, materials with higher friction values are disposed on the radial outer sides of the capping pieces.

In a significant embodiment, four longitudinal ribs, which form equal 90° angles with one another, are disposed as the elements which determine the cross section of the front functional element. The axial positions of these longitudinal ribs are offset by 45° relative to the main axes of the working disk, the centers of these longitudinal ribs intersecting in the center line and being disposed as elements forming the center line.

In a preferred embodiment of the invention, the operative sharp edges of the longitudinally acting double cutting teeth and the transversely acting working teeth are preferably disposed during the movement of the apparatus in the rotary kiln so as to strike the inner side of the rotary kiln perpendicularly with respect to the transverse axis as well as the longitudinal axis and the longitudinally acting double cutting teeth, the transversely acting working teeth and the compact area with its radial external points are disposed on a common circular path, which is assigned to the swung-out conicity adjusters, the compact area being disposed as supporting, rolling and installation unit. It is furthermore a part of this embodiment that these symmetric, longitudinally acting double cutting teeth are superimposed with their line of symmetry on the axis of the longitudinal ribs and that these longitudinally acting double cutting teeth are disposed symmetrically to the plane perpendicularly to the working disk, the radial external points of the sharp edges of the longitudinally acting double cutting teeth and the transversely acting working teeth being disposed as a hexagon with unequal sides symmetrically to the perpendicular. Two sides of this hexagon are disposed perpendicularly to and, at the same time, as large as the upper horizontal side. These three sides determine the size of the striking lever.

In a further embodiment of the invention, reinforcing plates with an accessible hollow space are disposed in the vicinity of and on both sides of the working disk and axially to the center line.

In an advantage refinement, the interchangeable working elements are disposed removably and non-positively on the respective plug-in receivers for the working elements and, moreover, with their radial external points, determined by their working edges, on the outer conicity line.

The invention is furthermore advantageously developed owing to the fact that these interchangeable working elements are disposed perpendicularly to, inclined to or parallel to the center line, forming a working edge, and that the interchangeable working elements, in the event of a parallel arrangement, have an edge length, which is longer than the longest edge length of a furnace stone in the longitudinal direction of the rotary kiln and that, in the event of an orthogonal arrangement, at least two working edges are disposed congruently and aligned on the outer conicity line. In this particular case, the edge length of the interchangeable working elements then form a space grid of the interchangeable working elements relative to one another or to the center of the sharp edges of the longitudinally acting double cutting teeth and of the transversely acting working teeth, said space grid being disposed unequal to and larger than half a stone grid in the longitudinal direction of the rotary kiln. It is furthermore a part of this embodiment that these interchangeable working elements are disposed so that their own center line is superimposed on the cross sectional axis of the longitudinal ribs and that, in the event of an arrangement parallel to the middle line, the working edges of the interchangeable working elements are provided with a weakly curved sharp edge and that, in the event of transversely disposed interchangeable working elements, the weakly curved sharp edges of the working edges is disposed in accordance with the curvature of the lining of the rotary kiln and that the axis of the sharp edges of the longitudinally directed interchangeable working elements is preferably constructed perpendicularly to the inner wall of the rotary kiln.

In an embodiment of the invention, the transverse ribs are disposed in the of the front functional element, forming a connection site in the approximate center of said front functional element. The length of the front functional element can be adjusted by means of said connection site.

The apparatus has special advantages. They may be seen to lie therein that the apparatus can be used for levorotary as well as also for dextrorotary kilns. It is a further advantage that small areas can be broken out or only deposit, without putting a critical stress on intact and adjacent regions. The weight is very low, so that the apparatus can also be handled easily during installation. Moreover, due to its simple construction, the apparatus can be adjusted easily and simply.

It is a form of the invention that, when the interchangeable working elements lie transversely, a weakly curved sharp edge is disposed to correspond to the curvature of the lining of the rotary kiln and the axis of the sharp edge of the longitudinally directed, interchangeable working elements is directed preferably perpendicularly to the interior wall of the rotary kiln.

In a further embodiment of the invention, the plug-in receivers of the working elements are disposed so as to be distributed uniformly over the periphery of the functional element in an extension of the radial external points of the longitudinal ribs.

It is within the perview of the invention that the working elements can be disposed detachably on the plug-in receivers.

The invention is advantageously perfected, since in the region of the working disk facing the thick end of the apparatus reinforcing ribs are provided, on which the plug-in receivers are located, swivel-mounted guiding systems of the conicity adjusters being pivotably guided in the reinforcing ribs.

A special or surprising success consists therein that current geometric relationships were found between the components, which make possible the simplicity, but also the effectiveness of the apparatus, to break out small areas.

In a preferred form of the invention, the curve between the working disk and the field connection extends in a convex formation, the curve being uniform and having an apex, which is at a greater distance from the working disk than is the center of gravity of the apparatus.

The invention is perfected owing to the fact that the external point of the transverse ribs is provided so as to finish flush at the outer edges of the longitudinal ribs.

DESCRIPTION OF THE DRAWING

The invention is explained in greater detail below by means of an example of the operation. In the associated drawing:

FIG. 1 shows a rotary kiln 31 of any diameter, which is to be freed, utilizing its existing driving mechanism, from deposit 32 and lining 33 or only from deposit 32 preferably in small break-out areas 35 with a breakout apparatus 1.

Figure 1:
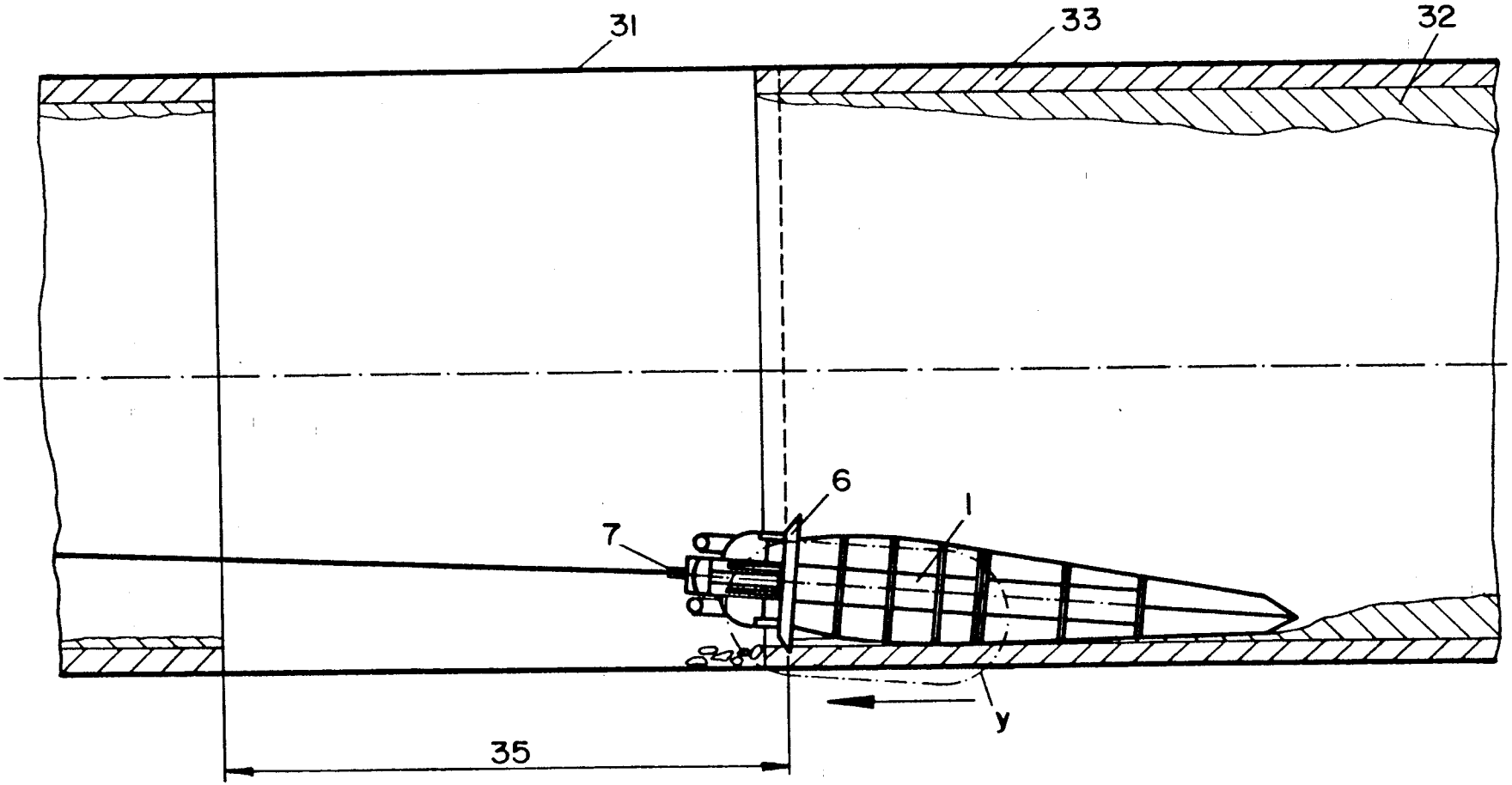
FIG. 1—a small area of the rotary kiln with the inserted apparatus in a sectional view.

The main components of the apparatus are the front functional element 2, the rear functional element 3, the working disk 6 and characteristic add-on pieces. The front functional element 2 is fashioned from the longitudinal ribs 18, which codetermine its outer conical shape, the embedded transverse ribs 19 and the reinforcing plates 20, which are important for the internal stability and form the hollow space. The longitudinal ribs 18 cross one another at half width at an angle of 90° and form in the intersection of their cross sectional centers the center line 8 of the apparatus 1. Disposed centrally and at right angles to this center line 8, there is at the thick end 10 of the apparatus 1, firmly connected in the longitudinal rib cross, the working disk 6, the axis of symmetry of which to the longitudinal ribs 18 is turned by 45° to the plane of the longitudinal ribs 18. Because of the special stress, the working disk consists of a stable sheet metal plate. Due to the deliberate geometric emphasis of its outer edge, regions are created for certain functions. These include the breaking-out tools, consisting of the two longitudinally acting double cutting teeth 14 (FIGS. 6, 8) and two transversely acting working teeth 15, as well as the compact region 16, which is fashioned mainly for installation, transport and bearing processes.

Taking into consideration the rotational operational movement of the apparatus 1, the projecting external points of the working disk 6 are located in a logical manner on a circular path 30. The system lines of the longitudinally acting double cutting teeth 14 and, in a comparable manner, of the transversely acting working teeth 15 lie on the axes of the cross sections of the longitudinal ribs, in order to ensure a reinforcement of the effective working regions and to exert an influence on the operational behavior of the apparatus 1.

The arrangement of the apparatus 1 is totally subjected to the objective of ensuring the breaking out of small areas 35 consisting of deposit 32 and lining 33 or also the separate breaking out of deposit 32 while preserving all adjacent areas with a minimum of total structural and technical effort.

An essential embodiment in this sense consists of the concentration of all elements involved in the breaking out on one working disk 6. By these means, the possibility is provided of ensuring a precise working front.

Figure 5:
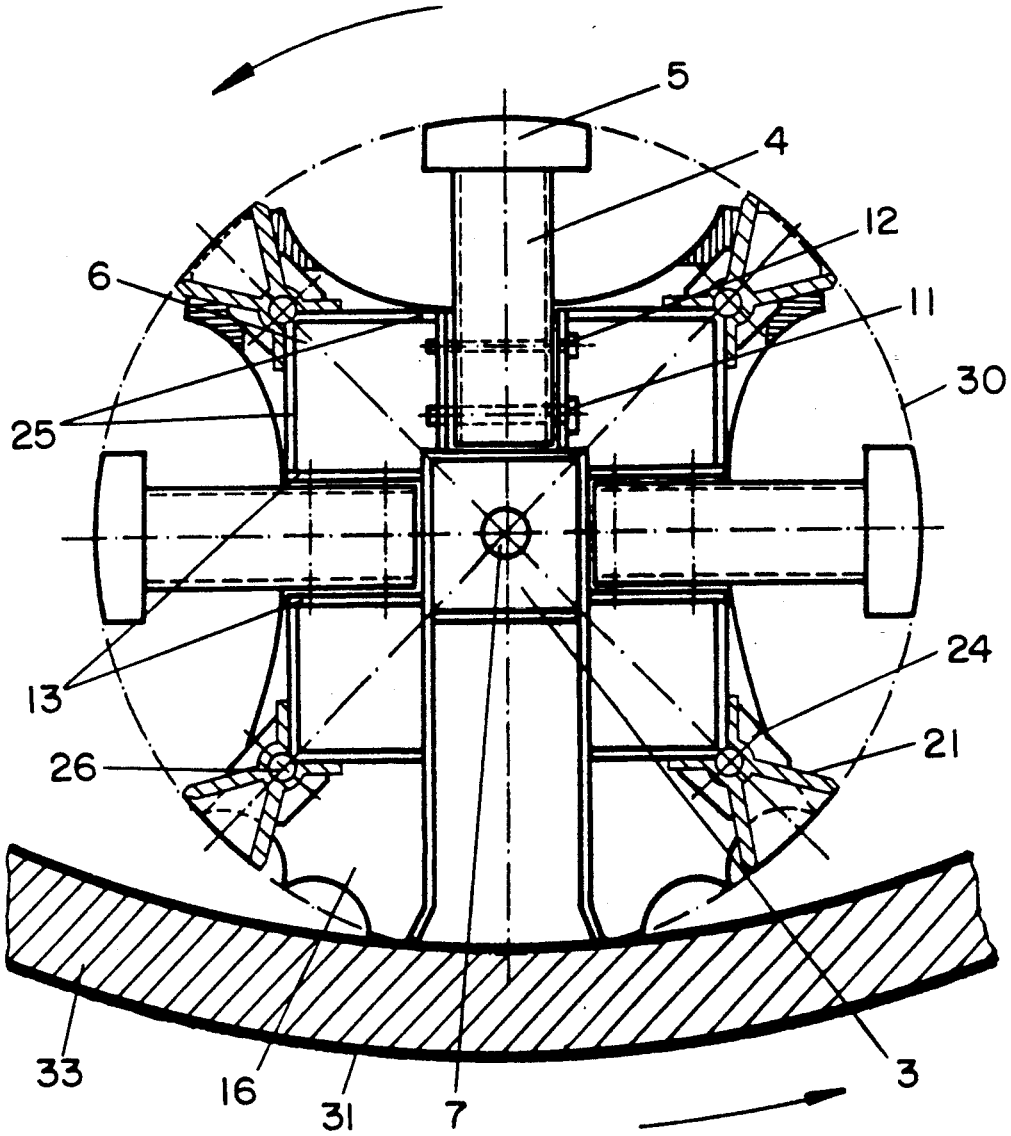
FIG. 5 shows the apparatus of FIG. 3 in overdrive.

The second, essential, constructive arrangement provision consists of the complex geometrical matching between the working disk 6 and the front functional element 2. This reflects itself characteristically in two different continuous lines, on the one hand, in the outer conicity line 27 and, on the other, in the inner conicity lines 28. Both form a conicity angle with the center line 8. Whereas the outer conicity lines 27, as well-marked lines of the outer enveloping figure of the apparatus 1 oriented in the longitudinal direction characterize the geometric figure of said apparatus 1 and can be defined exactly, the inner conicity lines 28 (FIG. 9) are an expression of the function and the interaction between the apparatus 1 and the action area in the active phase of the breaking out and thus are an imaginary auxiliary line. Looked at from another point of view, the outer conicity line 27 is the longitudinally directed tangential connection of contact points of the working disk 6 and of the front functional element 2 at their supports. The inner conicity line 28 also represents a tangent. This tangent, however, does not describe the linear connection between several points, but forms the tangent to a point of a curved or bent body edge of the longitudinal ribs 18. This is the support line or contact point of the front functional element 2 on the facing inner surface of the free or lined tubular cylinder. This arises out of the fact that the longitudinal ribs 18 have a slight curvature 29 at the outer edge approximately up to half their length and in the vicinity of the working disk 6. This curve 29 is convex up to the center line 8 and has its maximum at about the center of the curve 29. In the example selected, this corresponds to the section of the working disk and the field connection 34. The characteristic feature of this embodiment is the flexible support of the front functional element 2 in the area of the curve 29 of the longitudinal ribs 18. The exact position of the load bearing point in the breaking-out phase depends on the depth of penetration of the working disk 6. The deeper the penetration of the working disk 6, the more does the support point migrate on the curve 29 in the direction of the working disk 6. For the special case, in which the working disk 6 does not penetrate into the underlying strata, but is supported level with the support point of the front functional element 2, the inner conicity lines 28 and the outer conicity lines 27 are congruent. This corresponds to the essence of the motion in the overdrive (FIG. 5).

The result of the relationships shown is an apparatus 1, the mode of operating and functioning of which is determined causally and purposefully by its geometric shape. The essential advantages include the concentrated working action and the gentle stress on the area situated immediately in front of the break-out front by the appropriately shaped functional element 2.

Figure 9:
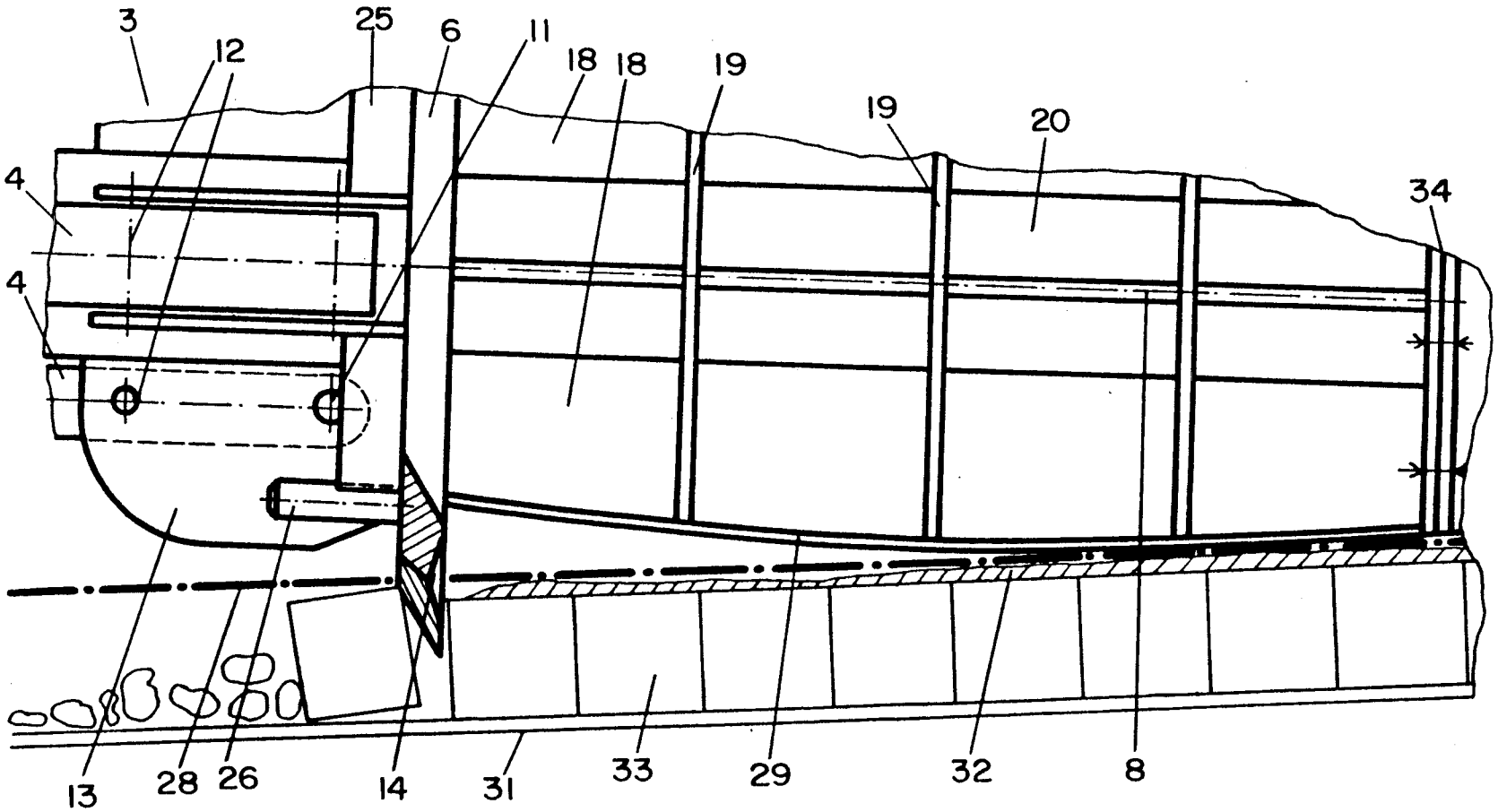
FIG. 9 shows the detail "Y" in FIG. 1.

With the described curve 29 of the longitudinal ribs 18, not only is a gentle, far extended distribution of load of the support forces from the front functional element 2 achieved, but at the same time the bridging of the free and load-sensitive break-out edge is secured (FIGS. 1 and 9). A number of transverse ribs 19 are incorporated to increase the strength of the functional element 2. At the same time, these transverse ribs 19 improve the skid resisting properties in contact with the lining. This skid resisting property is required for the movement of the apparatus 1 in the longitudinal direction. The center of gravity of the apparatus 1 as a whole is between the working disk 6 and the support point of the front functional element 2. Depending on the technological and functional requirements, the front functional elements 2 can be shifted in either direction, as required, by shifting the weight in order either to affect the average depth of penetration of the working disk 6 and, with that, the effect as a whole of the operation, or to match the bearing pressure of the front functional element 2 with respect to the movement behavior as a whole to the circumstances.

The apparatus 1 and, especially, the working disk 6 are designed so that the operational behavior is the same irrespective of the direction of rotation of the rotary kiln 31. For this reason, the working disk 6 is symmetrical and has double cutting teeth 14. Depending on the direction of rotation, only one cutting edge of the longitudinally acting double cutting teeth 14 is operational.

Figure 3:
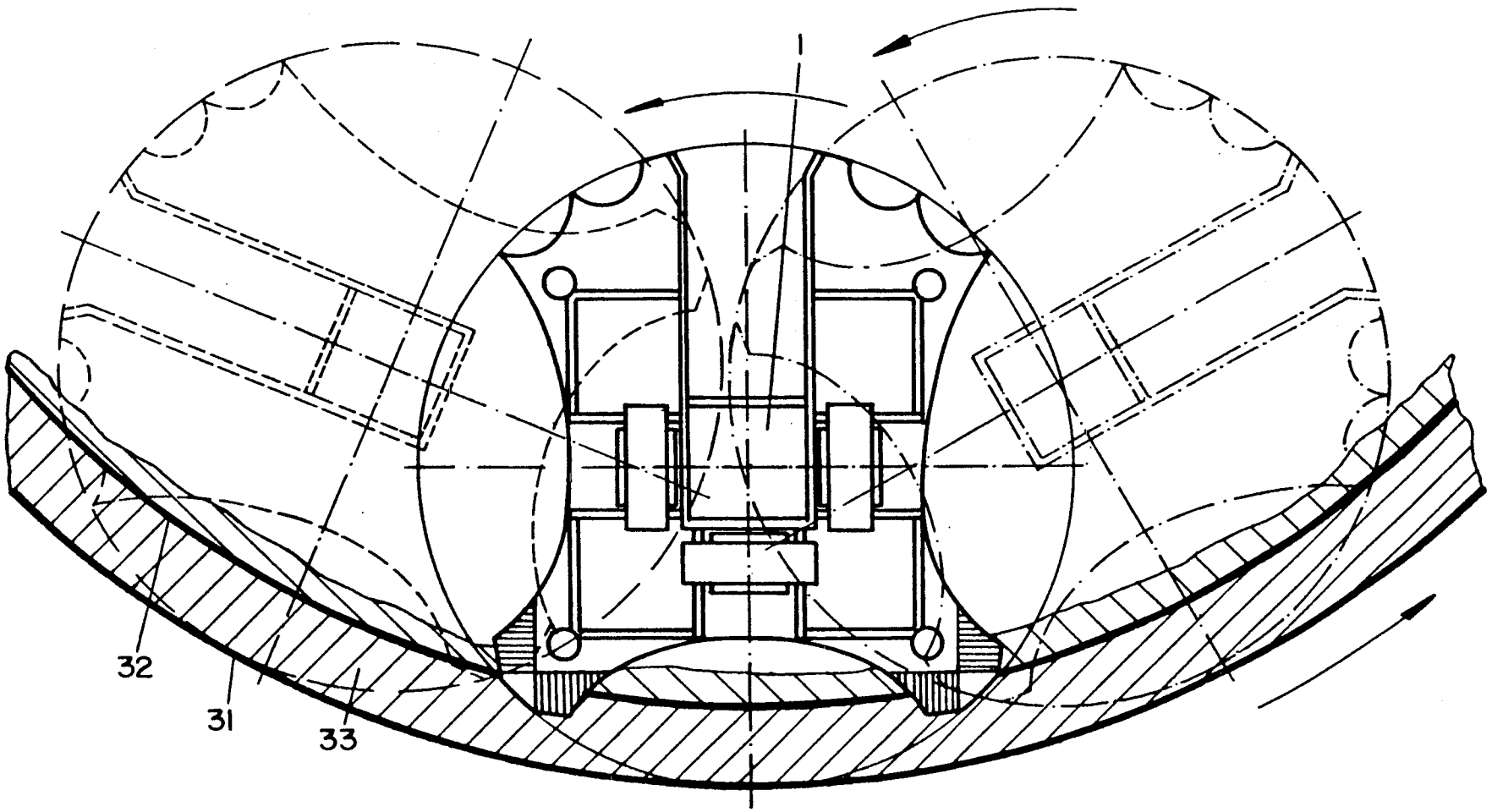
FIG. 3 shows a front elevation of the apparatus in the process of breaking out deposit and lining.
Figure 6:
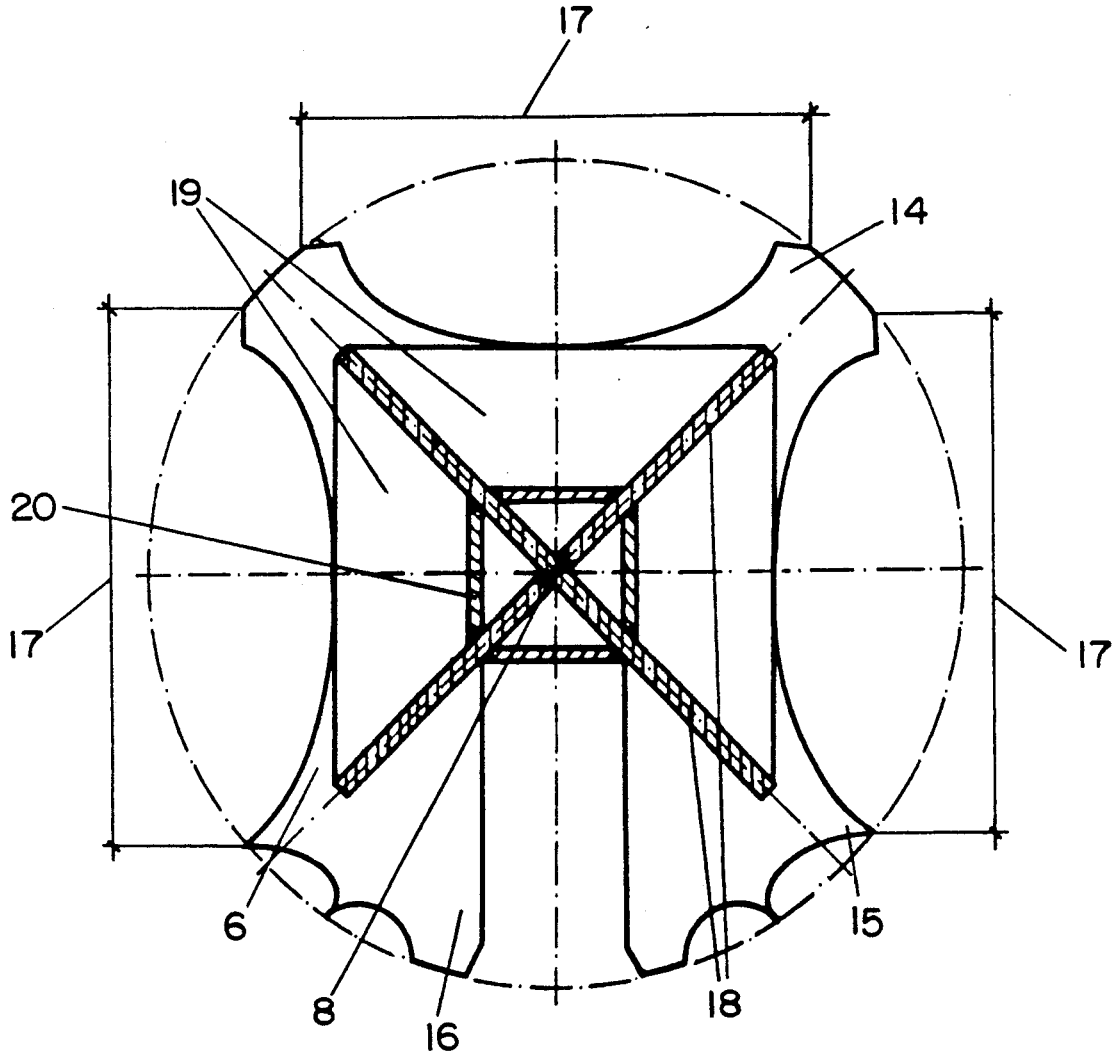
FIG. 6 shows the section A—A in FIG. 2.
Figure 7:
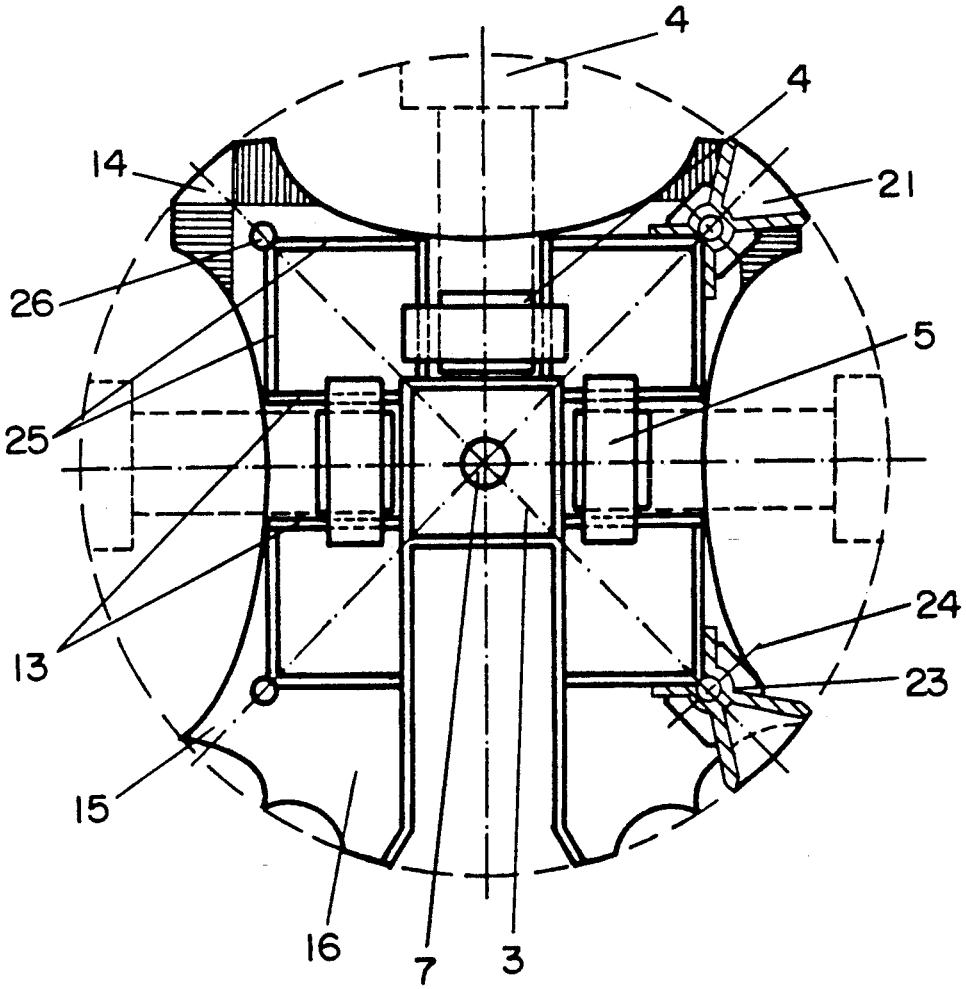
FIG. 7 shows the view X in FIG. 2.

The impact power of the apparatus 1 depends on the rotational speed of the rotary kiln 31, the mass of the apparatus 1 and also on the size of the striking lever 17 of the teeth (FIGS. 3 and 6).

Figure 2:
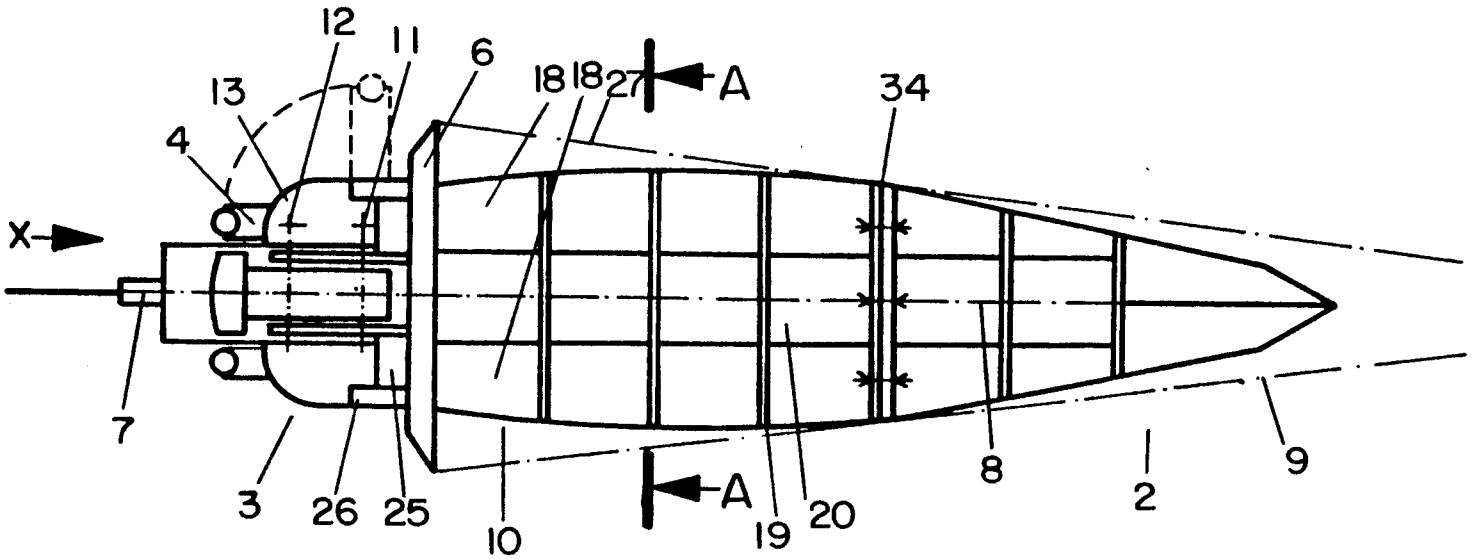
FIG. 2 shows the apparatus in side view.

At the thick end 10 of the apparatus 1, three swivel-mounted guiding systems 13, combining the rear functional element 3 and the working disk 6, are disposed on the main axes and aligned on the center line 8. The function of the swivel-mounted guiding systems 13 is to accommodate also three conicity adjusters 4, which have a swivelling axis 11 in the immediate vicinity of the connection between the working disk 6 and the rear functional element 3 and can be arrested in different positions at the outer edge of the swivel-mounted guiding system 13 by means of arresters 12 at different positions at an angle ranging over 90° (FIGS. 2 and 5). At the radial outer edge of the conicity adjuster 4, there is a curved capping piece 5 parallel or at an angle to the swivelling axis 11 of the conicity adjuster 4. In the swung-out state (FIG. 5), the radial external points of the capping piece 5 lie on a common circular path 30, which is assigned to the outer conicity line 27. Likewise and directly at the working disk 6, encircling reinforcing ribs 25 are disposed, which, exclusively following the direction of the main axes of the working disk 6 at the swivel-mounted guiding systems 13, meet on the cross sectional axes of the longitudinal ribs 18 at the thick end of the apparatus 1 and form the basis for four plug-in receivers 26 for the working elements 21, which are distributed uniformly over the periphery. Interlocking, interchangeable working elements 21, consisting of two working edges, which are firmly seated on two working edge bearings 23, are fixed with securing elements 24 on these plug-in receivers 26. The interchangeable working elements 21 may either be mounted on the apparatus 1 in the working position corresponding to FIGS. 4 and 5 only when needed or, in the event that they are not used, they may be kept, so that they may be more readily available, in a passive reserve position, in which their working edges 22 as well as their working bearings 23 are turned through 180°, but also fixed positively on the same plug-in receivers 26 with the securing elements 24. At the rear functional element 3, the spring-mounted connection for the rope swivel 7 is connected in an extension of the center line 8.

In the practical application, it is possible to differentiate between the different technological working operations, for which the apparatus 1 is fitted out with appropriate equipment or adjustment.

Essentially, it is possible to differentiate between three separate working operations of the apparatus 1:

| | |
|---|---|
| 1. Overdrive on interior surface | corresponding to FIG. 5 |
| 2. Breaking out deposit separately | corresponding to FIG. 4 |
| 3. Breaking out deposit and lining | corresponding to FIGS. 1 and 3. |

In overdrive, the primary aim is to have the apparatus 1 pass at an appropriate rotational speed of the rotary kiln 31 over areas that are to be preserved in order to carry out a selective breaking out of deposit 32 and lining 33 at a different place. For this course of motion, all sharp and operative edges of the apparatus 1 are disengaged by an adjustment, as shown in FIG. 5. For this purpose, the three conicity adjusters 4 are swung out at right angles to the center line 8 and arrested with arresters 12. In addition, the four interchangeable working elements 21 are attached to the plug-in receiver 26. In this way, the longitudinally acting double cutting teeth 15 are bridged and, by disengaging the striking lever 17, the knocking effect of the apparatus 1 is converted into almost a rolling motion.

Figure 4:
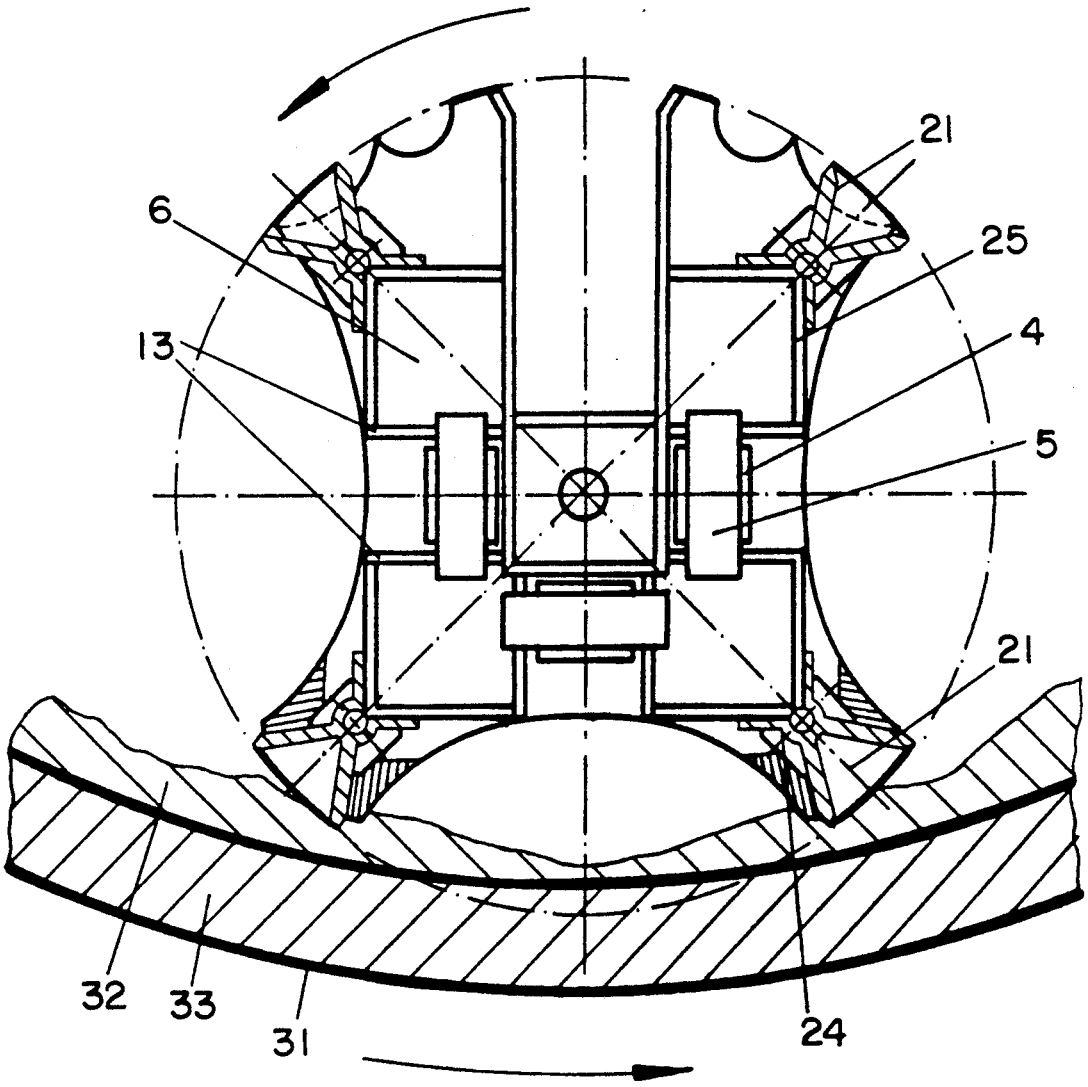
FIG. 4 shows the apparatus of FIG. 3 separately breaking out deposit.
Figure 8:
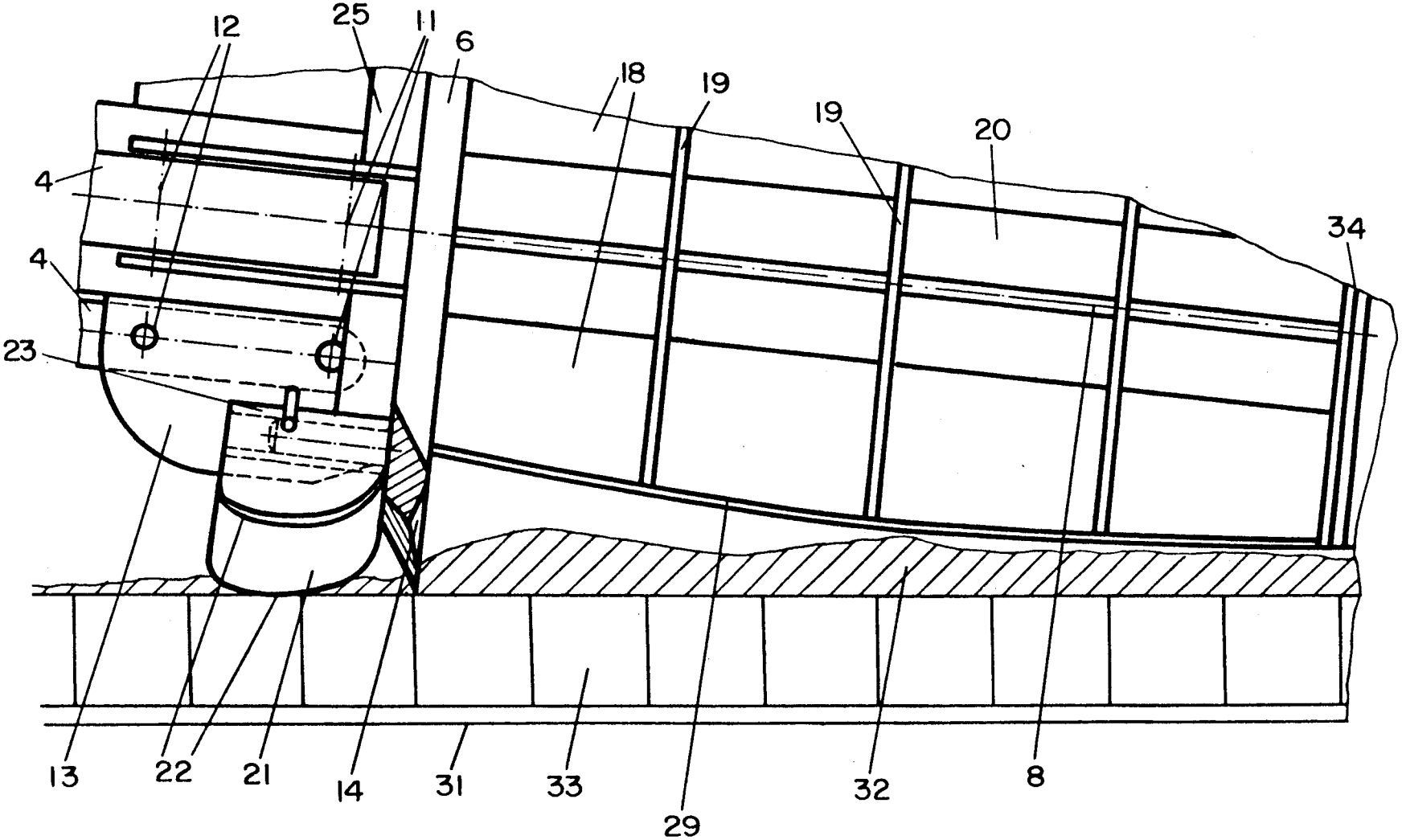
FIG. 8 shows a schematic sideview of the apparatus with the cutting tools riding above the kiln lining.

In order to exclude any unwanted penetration into the joints and grooves of the lining 33 during the overdrive, the working edges 22 of the interchangeable working elements 21 are appropriately fashioned in length or in grid distance (FIG. 8). When the deposit 32 is broken out separately, the conicity adjusters 4 remain swung in, but the interchangeable working elements 21 are attached. With that the apparatus 1 has the ability to carry out impacting activity. However, the design of the interchangeable working elements 21, which in turn are disposed so that, in working positions, they strike the inner wall of the rotary kiln 31 perpendicularly with their working edges 22, is such, that these elements cannot attack the lining effectively, since penetration of the interchangeable working elements 21 and of the working disk 6 with the longitudinally acting double cutting teeth 14 and the transversely acting working teeth 15 is constructively prevented. The breaking-out effect for the deposit 32 with the amorphous structure is, however, retained in an advantageous manner (FIG. 4).

When breaking out the lining 33 with or without a deposit 32 thereon, it is important to penetrate the joints and grooves and to divide the curved structure primarily in the longitudinal direction of the rotary kiln 31. For this purpose, the conicity adjusters 4 remain swung in, as shown in FIG. 3, and the interchangeable working elements 21 are also not attached. The apparatus 1 can thus develop its full impact force and the longitudinally acting double cutting teeth 14 and the transversely acting working teeth 15 penetrate the joints and grooves of the lining 33 as the rotary kiln 31 rotates and thus destroy the arched roof without endangering adjacent lining 33.

In about the center of the longitudinal direction of the front functional element 2, there is a favorable possibility for a field connection 34. The pointed front end 9 can thus be exchanged for different sizes as required.

It is furthermore also possible to change the center of gravity of the apparatus 1 without making the pointed end front 9 longer. For this purpose, the weight of the pointed end is increased by disposing ballast weights at the longitudinal ribs 18.

We claim:

1. Apparatus for selectively breaking out deposits from and/or lining of rotary kilns, which comprises means for moving the apparatus lengthwise in a kiln, a substantially conical front end having a mounting fixture for attaching the conical front end to the rest of the apparatus, a substantially rounded rear end, a plurality of outwardly curved longitudinal ribs having an outermost point, said ribs being spaced apart from each other around a notional centerline, a transverse rib for securing said spaced apart positioning of said longitudinal ribs, said longitudinal ribs connecting said front and rear ends, a working disk having working elements thereon, said working disk being located substantially between said longitudinal ribs and said rear end, an outer notional straight conicity line drawn between the outer periphery of said working disk and said outermost point, and a momentary inner notional straight conicity line drawn between a point on said working disk which point is within the outermost diameter of said disk by a distance to which working elements have momentarily penetrated into the material to be broken out and a momentary tangential contact point on the outwardly curved longitudinal ribs, the position of said momentary contact point being determined by the extent of the momentary penetration into the material to be broken out, said inner notional conicity line being formed inwardly of said outer notional straight line during operation of the apparatus, and said outer and said inner notional straight conicity lines coincide with each other when the apparatus is not engaged in breaking out operation.

2. The apparatus of claim 1, wherein said working elements include points extending from said working disk and formed as radial cutting teeth and transverse cutting teeth, the apparatus further comprising a plurality of pivotable conicity adjusters arranged about said notional centerline and adapted to be locked in any of their pivoted positions, and said pivotable conicity adjusters have ends which when fully pivoted outwardly are contact points of said outer notional straight conicity line.

3. The apparatus of claim 2, further comprising a plurality of receivers mounted from said working disk for mounting working elements on said disk, said means for moving comprises a swiveling cable pull, and wherein the extent to which said pivotable conicity adjusters are swiveled inwardly or outwardly depends on whether the apparatus is intended to break out a deposit, break out kiln lining, or roll on the interior surface without breaking out action.

4. The apparatus of claim 3, wherein said pivotable conicity adjusters are each provided with a pivot axis, and are each adapted to pivot at an angle from 0° to 90° relative to the notionally centerline, the ends of each of said pivotable conicity adjusters being provided with a cap having a curved outer surface.

5. The apparatus of claim 4, wherein each of said caps are of a wear-resistant material and said caps are each disposed parallel or at an oblique angle to said pivot axis.

6. The apparatus of claim 5, wherein the curvature of the outer surface of each cap is substantially similar to the circular path of the periphery of the working disc with all conicity adjusters being pivoted out, wherein the arc length of the curve of the curved surface of each cap is not smaller than 1/16 of the periphery of said circular path.

7. The apparatus of claim 1, wherein four longitudinal ribs are provided, each disposed at an angle substantially 90° relative to an adjacent rib.

8. The apparatus of claim 1, wherein said mounting fixture is adapted to change the length of said front end.

9. The apparatus of claim 1, wherein the curvature of the outwardly curved longitudinal ribs has an outward apex which is further forward of the working disc then from the center of gravity of the apparatus.

* * * * *